United States Patent [19]

Engel

[11] 4,163,225

[45] Jul. 31, 1979

[54] MAILBOX SIGNALLING DEVICE

[76] Inventor: George W. Engel, 126 Bay View Dr., Toms River, N.J. 08753

[21] Appl. No.: 812,750

[22] Filed: Jul. 5, 1977

[51] Int. Cl.[2] ..... G08B 21/00

[52] U.S. Cl. ..... 340/569

[58] Field of Search ..... 340/281, 213 R, 371, 340/366 R, 283, 569

[56] References Cited

U.S. PATENT DOCUMENTS

| | | | |
|---|---|---|---|
| 3,261,010 | 7/1966 | Kardel | 340/283 |
| 3,935,994 | 2/1976 | Darvishian | 390/281 |

FOREIGN PATENT DOCUMENTS

| | | | |
|---|---|---|---|
| 1381747 | 11/1963 | France | 340/281 |
| 2547482 | 4/1977 | Fed. Rep. of Germany | 340/569 |

*Primary Examiner*—Glen R. Swann, III

*Attorney, Agent, or Firm*—Henry K. Leonard

[57] ABSTRACT

A device for signalling when a remote receptacle such as a rural mailbox has been opened. The device includes a switch that is closed by the opening of the box, a relay actuated thereby, a hold-in circuit established by the relay, a signalling means such as a buzzer or a light or both that is energized when the relay is actuated and a reset switch in the hold-in circuit for disabling the relay and the signalling means.

3 Claims, 3 Drawing Figures

MAILBOX SIGNALLING DEVICE

BACKGROUND OF THE INVENTION

It has been suggested in the past that receptacles such as mailboxes into which postmen place letters and other items should be provided with some signalling means by which the owner or patron can be informed that an object has been placed in the box. Many rural mailboxes are equipped with a flag which the postman or other delivery man is supposed to raise when he puts an object into the box to indicate to the householder that he has done so. This requires a positive act on the part of the postman and, often the flags become rusty and stick or the postman does not bother to raise the flag. In addition, of course, if the patron is blind, he cannot see the raised flag and does not known that mail has been placed in the box thus requiring that he visit the box periodically to see whether anything has been delivered.

Some prior art devices include audible signalling means such as door bells or the like which are caused to ring when the box is opened and which are shut off when the box is again closed. While this may be effective to call the attention of the householder if he happens to be in the house when the mail is delivered, it does not create a long lasting signal which an absent householder will see when he returns to his home. Other devices have been suggested in which the postman is required to manually close the switch at the time he places the mail in the box which causes a bell to ring continuously until such time as the householder opens the box, removes the mail, and opens the switch.

All of these devices have some flaws in their mode of operation whether it be the postman's reluctance to have to take an extra action, the householder's inability to hear a signalling device such as a bell if he happens to be deaf, the face that the signal is given only once when the box is opened and then closed.

It is, therefore, the object of the instant invention to provide a simple device having a circuit which is closed when the box is opened by the postman to place mail in the box, which sets up a circuit that is held in until the householder takes some positive action to disable the circuit and which provides for either visible or audible signals of the fact that the mailbox has been opened.

It is yet another object of the instant invention to provide a signalling device for a mailbox or similar receptacle which does not indicate to a passer-by that mail or other objects have been placed in the box, as is done when a signal flag is raised by the postman, and yet positively indicates to the householder that someone has opened the box and, therefore, that there probably is something in the box which the householder should collect.

It is yet another object of the instant invention to provide a signalling device for a remotely located mailbox such as a rural mailbox which automatically is actuated when the box is opened, and provides either a visible or an audible signal to the householder that the box has been opened; the device having means for disabling or reseting the signalling means when the householder notices that the signal has been energized, thus obviating the necessity for the householder to make frequent trips to the mailbox to ascertain whether or not mail has been delivered and resulting in the saving of considerable effort as well as conserving energy by eliminating the frequent opening and closing of the doors when the householder makes trips to the mailbox.

DESCRIPTION OF PREFERRED EMBODIMENT

Figure 1:
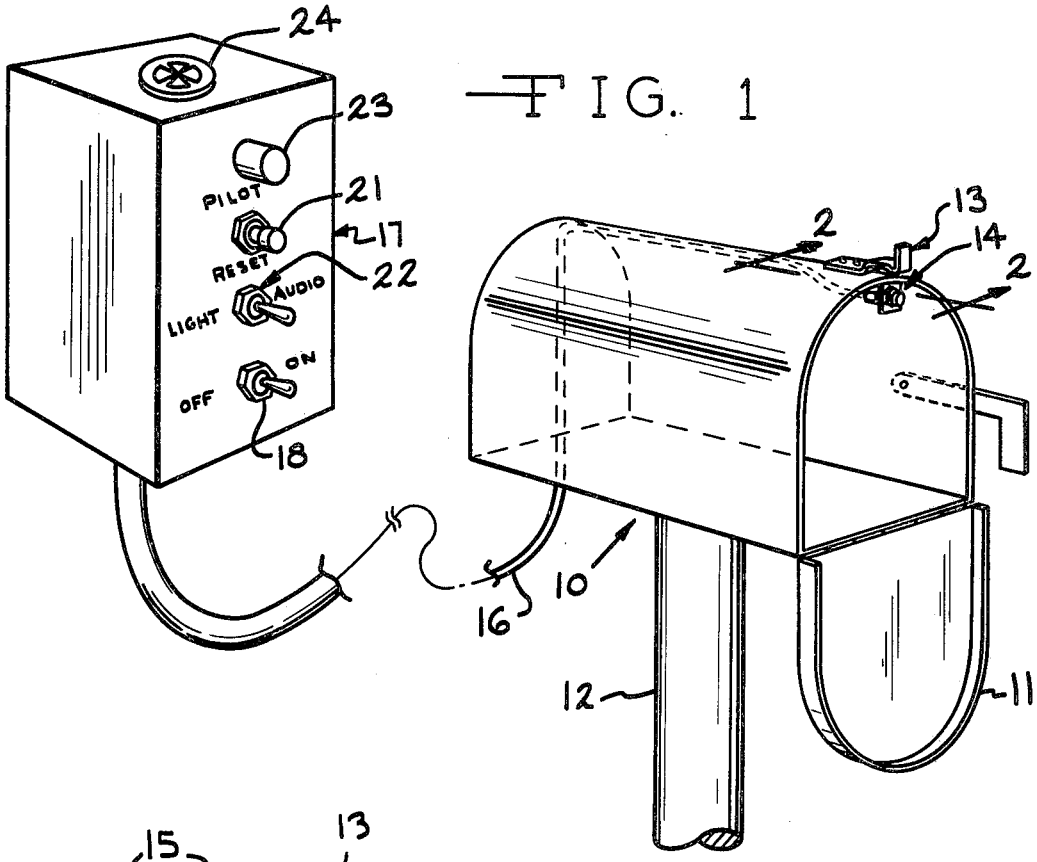
FIG. 1 is a fragmentary view in perspective showing a rural-type mailbox equipped with a signalling device embodying the invention.
Figure 2:
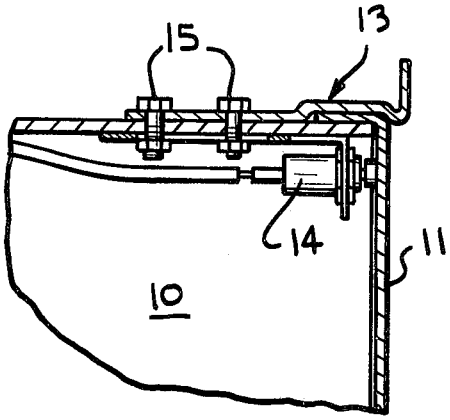
FIG. 2 is a greatly enlarged fragmentary vertical sectional view taken along the lines 2—2 of FIG. 1.

In FIG. 1 there is illustrated a conventional rural-type mailbox generally indicated by the reference number 10 which has a door 11 usually hinged along its bottom edge which can be swung between a closed position (fragmentarily shown in FIG. 2) and an open position as is shown in FIG. 1. A rural mailbox of this type usually is located on a post 12 adjacent the road and some distance from the house. The box 10 usually has a simple latch 13 which holds the door 11 shut as also is shown in FIG. 2.

According to the invention, a box of this type is equipped with an electrical switch 14 which preferably is mounted at the upper side of the box 10, possible by the same rivets or bolts 15 which secure the latch 13 in place. The switch 14 is normally held open by the door 11 and comprises a spring which urges it outwardly to close its electrical contacts whenever the door 11 is swung downwardly as, for example, by a postman placing mail in the box.

Figure 3:
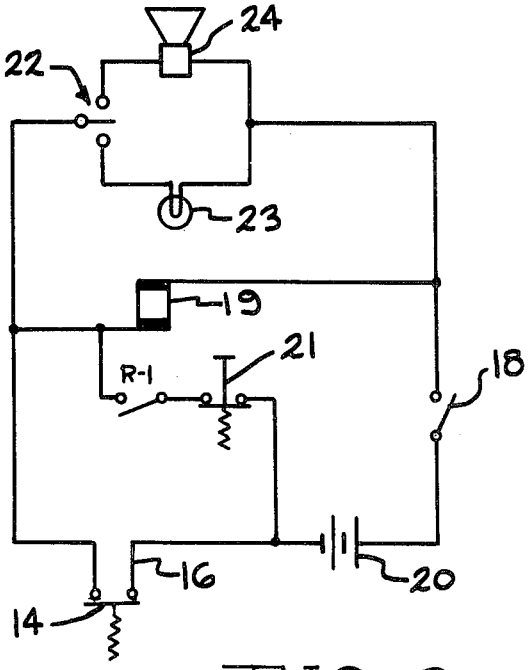
FIG. 3 is a simplified wiring diagram of a signalling means embodying the invention.

The switch 14 (see also FIG. 3) is electrically connected by a two-lead conductor 16 into a control circuit located in a control box generally indicated by the reference number 17 positioned in the house where the home owner readily can either see or hear the signal resulting from the opening of the mailbox 10.

The control circuit comprises the switch 14 and a main off-on switch 18. When the switch 18 is closed and the switch 14 is closed by the opening of the door 11, a circuit is established from the switch 14 through the coil of a relay 19, the off-on switch 18 and a battery 20 or other source of current. Energizing the relay 19 causes it to close its normally open contacts R-1 which establishes a parallel circuit from the battery 20 through a normally closed reset switch 21, the contacts R-1 and the relay coil 19. At the same time that the switch 14 is closed to establish the circuit just described, a second parallel circuit also is established from the battery 20 through the switch 14 and a selector switch 22 to either a pilot light 23 or a buzzer 24 and then through the on-off switch 18 to the battery 20. This parallel circuit is also held in by the closing of the relay 19.

The energizing of either the lamp 23 or the buzzer 24, depending upon which signalling means the householder prefers to use, signals to him that the mailbox has been opened.

If the householder immediately becomes aware of the signal given by the pilot light 23 or the buzzer 24, he may push the reset switch 21 breaking the hold-in circuit to the relay 19 which then drops out, opening its normally open contact R-1 and and restoring the circuit to condition for energization upon the next opening of the mailbox. On the other hand, if the householder is not immediately aware of the signal, he will become aware of it when he returns to the location of the control box 17 and can then reset the device.

The selector switch 22 provides an alternative way of signalling. For example, if the householder's control box 17 is located in one part of the house and he or she plans to be in another portion of the house, the selector switch 22 may be swung to put the buzzer 24 in circuit so that the actuation of the mailbox door 11 will be signalled in a manner perceptible from the other location. On the other hand, if the householder is hard of hearing, the switch 22 may be preset to place the pilot light 23 in circuit so that the signal will be called to the visual attention of the householder.

Having described my invention, I claim:

1. A signalling device for a mailbox having a door, or the like, said device comprising, in combination, (a) a biased, normally closed, first electrical switch that is held open by said door when said door is closed, (b) a control box located at a position remote from said mailbox, (c) control means located within said control box, said control means including, (1) signalling means, (2) an "on-off" switch, (3) a normally closed re-set switch, (4) latchable switching means consisting of a normally open switching portion and a current responsive portion for closing said switching portion, (5) a source of electrical energy, and (d) electrical circuit means consisting of (1) a first loop from said source to said first switch and therefrom to said signalling means and therefrom through said "on-off" switch to said source, (2) a second loop from said source to said first switch and therefrom to said current responsive portion of said latchable switching means and therefrom through said "on-off" switch to said source, and (3) a hold-in loop having two branches, the first of said branches leading from said source through said re-set switch to one side of said normally open portion of said latchable switching means and from the other side of said normally open portion through said current responsive portion thereof and said "on-off" switch to said source, and the second of said branches leading from said other side of said normally open portion to said signalling means and therefrom through said "on-off" switch to said source.

2. A device according to claim 1 in which the signalling means consists of an audible signalling means and a visible signalling means and the device includes a switch for placing the selected signalling means in circuit.

3. A device according to claim 1 in which the latchable switching means is a electrical relay having a coil and normally open contacts.

* * * * *